US007341398B2

(12) United States Patent
Johnson et al.

(10) Patent No.: US 7,341,398 B2
(45) Date of Patent: Mar. 11, 2008

(54) LIFT-ASSISTED MANHOLE COVER

(75) Inventors: Jeremy I. Johnson, East Jordan, MI (US); Lee M. Veldboom, East Jordan, MI (US); Scott B. Beal, East Jordan, MI (US); Herbert Carl Barnum, East Jordan, MI (US); William R. Austin, Ellsworth, MI (US); James F. Malpass, East Jordan, MI (US); Todd C. Loviska, East Jordan, MI (US); Brian J. Rachwitz, East Jordan, MI (US); Rex A. Garringer, Ardmore, OK (US); John H. Snyder, Boyne City, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 0 days.

(21) Appl. No.: 11/420,083

(22) Filed: May 24, 2006

(65) Prior Publication Data

US 2007/0274779 A1 Nov. 29, 2007

(51) Int. Cl.
*B65D 43/18* (2006.01)

(52) U.S. Cl. ..... 404/25; 137/371; 220/816

(58) Field of Classification Search ..... 404/25, 404/26; 137/371; 220/816; 20/816
See application file for complete search history.

(56) References Cited

U.S. PATENT DOCUMENTS

| | | | | |
|---|---|---|---|---|
| 544,409 | A * | 8/1895 | Jauch | 220/816 |
| 1,225,679 | A * | 5/1917 | Ranshousen | 220/210 |
| 1,314,306 | A * | 8/1919 | Cullison | 220/86.2 |
| 1,399,759 | A * | 12/1921 | Fullenwider | 220/291 |
| 1,634,029 | A * | 6/1927 | Korkames | 220/816 |
| 1,992,354 | A | 2/1935 | Coleman | |
| 2,295,909 | A * | 9/1942 | Massey | 248/147 |
| 2,439,978 | A * | 4/1948 | Konchan | 70/455 |
| 3,262,227 | A * | 7/1966 | Pentecost | 49/354 |
| 3,561,162 | A | 2/1971 | Goldman | |
| 4,038,789 | A | 8/1977 | Axgarde | |
| 5,184,422 | A | 2/1993 | Wade | |
| 5,451,119 | A | 9/1995 | Hondulas | |
| 5,507,590 | A | 4/1996 | Argandona | |
| 5,531,541 | A * | 7/1996 | Clover et al. | 404/25 |
| 5,788,406 | A | 8/1998 | Hernandez | |
| 6,035,581 | A * | 3/2000 | McCoy | 52/20 |
| 6,095,365 | A * | 8/2000 | Yielding | 220/264 |
| 6,446,307 | B2 | 9/2002 | Wilkins | |
| 2005/0244227 | A1 | 11/2005 | Akkala | |

FOREIGN PATENT DOCUMENTS

| | | |
|---|---|---|
| DE | 19514636 | 10/1995 |

* cited by examiner

*Primary Examiner*—Gary S. Hartmann
(74) *Attorney, Agent, or Firm*—Warner Norcross & Judd

(57) ABSTRACT

A lift-assisted manhole cover assembly with a flush surface and external pivot shaft. The cover includes a mounting tab that extends beyond the general periphery of the cover. The mounting tab may be connected to a shaft that is threadedly engaged with the frame. A spring may be mounted between the frame and the mounting tab, for example, in a sleeve, to provide a mechanical assist in lifting the cover. The sleeve may be disposed outside the manhole opening where it does not block access to the manhole opening.

6 Claims, 4 Drawing Sheets

LIFT-ASSISTED MANHOLE COVER

BACKGROUND OF THE INVENTION

The present invention relates to manhole covers, and more particularly to lift-assisted manhole covers.

Manhole covers are well known. Generally, a manhole cover is a removable plate forming the lid over the opening of a manhole to, among other things, prevent someone from falling in and to keep unauthorized persons out. Manhole covers often weigh more than 100 pounds, partly because the weight keeps them in place when traffic passes over them, and partly because they are often made out of cast iron, sometimes with infills of concrete. This makes them inexpensive and strong, but heavy. They often feature pick holes, in which a hook handle is inserted to lift them up.

Because of the weight of manhole covers, various efforts have been made to make them easier to open. More specifically, spring-assisted manhole covers are disclosed in U.S. Pat. Nos. 6,446,307 to Wilkins, 5,788,406 to Hernandez, 5,507,590 to Argandona, and U.S. Patent Application 2005/0244227 to Akkala. Each of these manhole covers swing along a vertically arced path. Unfortunately, in some circumstances, the cost of providing the necessary spring force to assist the cover in such a manner is prohibitive. Further, the manhole cover may not have room to swing a full vertical arc.

These issues have been addressed by horizontal swing spring-assisted manhole covers, such as those disclosed in U.S. Pat. No. 5,184,422 to Wade and German Patent DE19514636 to Galvanetto. In these covers, the spring applies a permanent lifting force to the cover and when the cover is unlocked the spring assists the cover vertically to just above the top edge of the manhole frame. Once the cover clears the edge of the manhole frame, the cover may be moved horizontally to allow access to the manhole shaft. Unfortunately, in Galvanetto, access to the manhole is partially blocked even when the cover is fully opened. Wade suffers in that the spring and locking mechanism extend substantially higher than the surface of the manhole cover making it difficult to drive a car or walk over the manhole cover.

SUMMARY OF THE INVENTION

The aforementioned problems are addressed by the present invention which provides an improved lift-assisted manhole cover assembly. In one embodiment, the lift-assist mechanism is located outside the periphery of the hole and is located below the upper surface of the manhole cover. In this embodiment, the cover may include a mounting tab that extends beyond the general periphery of the cover. The mounting tab is movably mounted to the frame, for example, using a threaded shaft. The cover and shaft are capable of moving vertically with respect to the frame. Additionally, the cover may be rotated with respect to the frame about the shaft (or the shaft may rotate with respect to the frame). A spring or other biasing element may be included to provide additional mechanical assist in lifting the cover. For example, a spring may be mounted around the shaft between the cover and the frame.

In one embodiment, movement of the cover and shaft is achieved by operation (e.g. rotation) of the threaded shaft. In this embodiment, the shaft may be threadedly interconnected with the frame such that rotation of the shaft causes to move linearly with respect to the frame. In one embodiment, the threaded shaft is a bolt that is fitted freely through the mounted tab and threadedly engaged with the frame. The bolt may be firmly interlocked with the cover by a cotter pin or other similar mechanism to, among other things, resist tilting of the cover about the bolt and to translate linear movement of the bolt into linear movement of the cover.

The present invention is a simple and effective lift-assisted manhole cover. In those embodiments with an externally-located lift-assist mechanism, access to the manhole is not obstructed by the lifting mechanism when the cover is fully opened because the mounting tab is positioned outside of the manhole. In some embodiments, the lift-assist mechanism is located below the cover, thereby permitting the manhole assembly to have a flat, uniform upper surface. In those embodiments that include a threaded interconnection between the shaft and the frame, the cover is easily raised and lower by operation of the shaft. Some embodiments include an interlocking relationship between the cover and the shaft that helps to maintain the cover substantially perpendicular with respect to the shaft.

These and other objects, advantages, and features of the invention will be readily understood and appreciated by reference to the detailed description of the current embodiment and the drawings.

DESCRIPTION OF THE CURRENT EMBODIMENT

I. General Description

Figure 1:
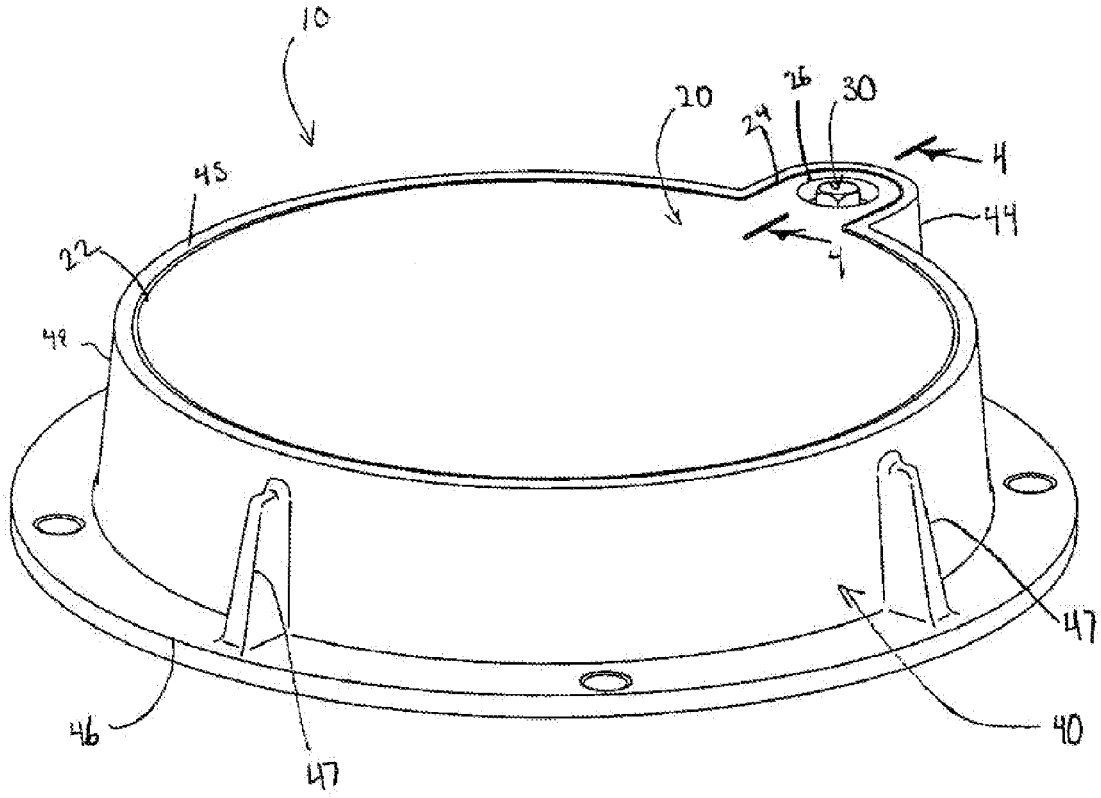
FIG. 1 is a perspective view of the lift-assisted manhole cover assembly.
Figure 2:
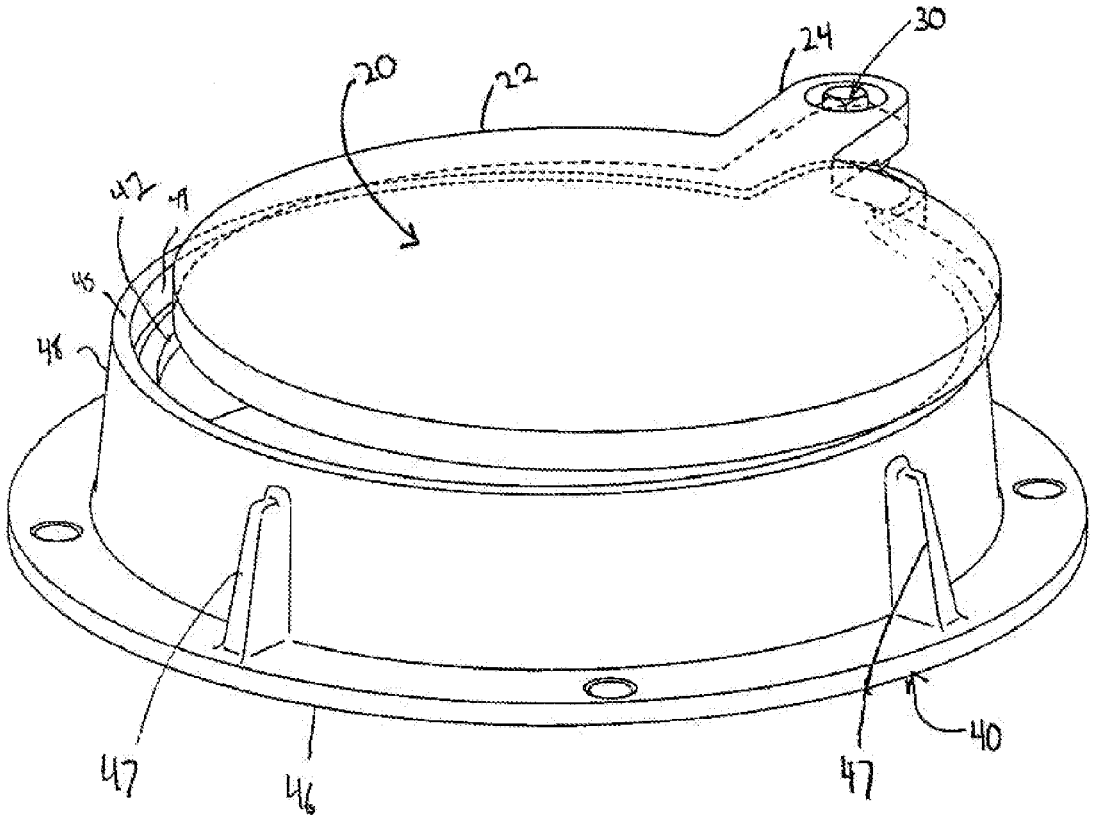
FIG. 2 is a perspective view of the partially opened lift-assisted manhole cover assembly.

An embodiment of the lift-assisted manhole cover assembly of the present invention is illustrated in FIGS. 1-5, and generally designated 10. The manhole cover assembly 10 generally includes a manhole cover 20, a frame 40, and a lifting element such as a threaded shaft 32 or a spring 34 for assisting in lifting the manhole cover 20 off of the frame 40. In one embodiment, a portion of the manhole cover 20 extends beyond the general periphery of the cover to form a mounting tab 24. The shaft 32 interacts with the mounting tab 24 to provide a pivot point external to the general periphery of the cover.

The manhole cover assembly 10 may be installed with bedding or infills to provide a flush surface capable of being driven or walked on without obstructions extending above the surface. In operation, the lifting element provides vertical assist to help the cover 20 clear the frame 40. The cover 20 may be swung horizontally to an open position where the cover 20 does not block access to the manhole.

II. Description of the Lift-Assisted Manhole Cover Assembly

The described embodiment may be used as a lift-assisted manhole cover assembly to provide access to an infrastructure, such as a drainage and sewer infrastructure system. Although the manhole cover assembly may be installed over any suitable hole, it will often be installed over a manhole in a street or sidewalk. As noted above, the lift-assisted manhole cover assembly generally includes a frame 40, a cover 20, and a lifting element, each of which are described in more detail below.

In the illustrated embodiment, the frame 40 is a generally peripheral structure including an inner wall 49 and an outer wall 48. The illustrated embodiment includes a cover receiving flange 42 disposed on the inner wall 49, a frame supplement 44 (depicted as boss 44 in the illustrated embodiment shown in FIG. 1) disposed on or near the frame 40, and installation members 46, 47 disposed on the outer wall 48. The described frame 40 is generally annular and may be installed over a manhole (not shown). The configuration of the top edge 45 and the inner wall 49 of the frame 40 may be selected to interface with the cover 20, as described in more detail below. In one embodiment, the frame 40 is installed flush with the surface of a road (not shown).

Figure 3:
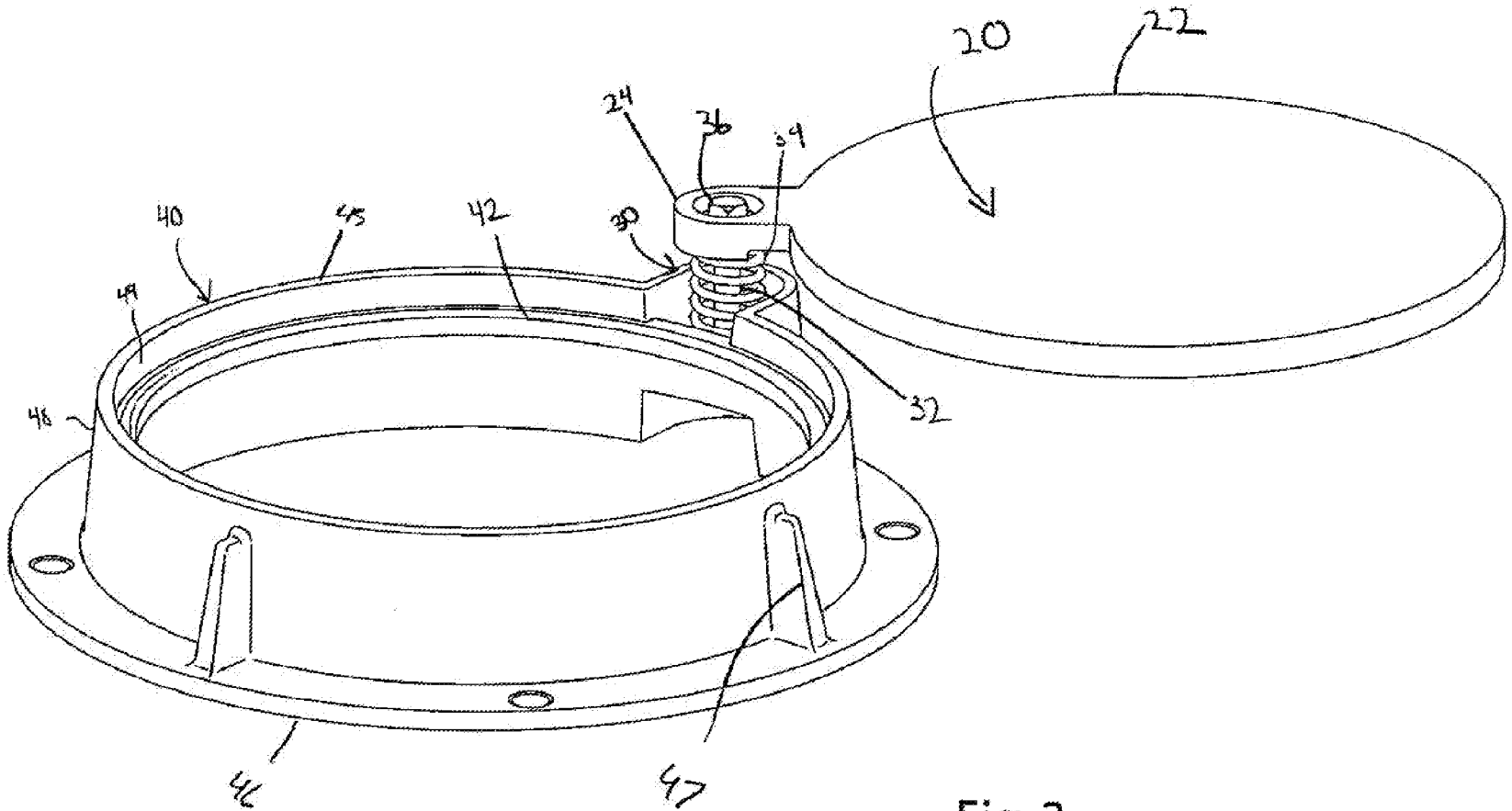
FIG. 3 is a perspective view of the open lift-assisted manhole cover assembly.

In the illustrated embodiment, the cover receiving flange 42 extends inwardly from the inner wall 49 of the annular frame 40, as perhaps best shown in FIG. 3. In closed position, shown in FIG. 1, the cover 20 rests on the cover receiving flange 42 preventing the cover from falling into the manhole (not shown). Optionally, in one embodiment, the cover 20 forms a waterproof seal with a neoprene gasket 70, shown only in FIG. 4, disposed on the cover receiving flange 42. The shape and size of the cover receiving flange 42 may be selected to form to the shape of the cover 20 or selected to be any other suitable shape and size. Typically the cover receiving flange 42 will be integrally formed along the entire inner periphery 49 of the frame 40 and made of the same material, although alternative suitable constructions are contemplated. For example, the cover receiving flange 42 may extend along only a portion of the inner wall of the frame 40.

Figure 4:
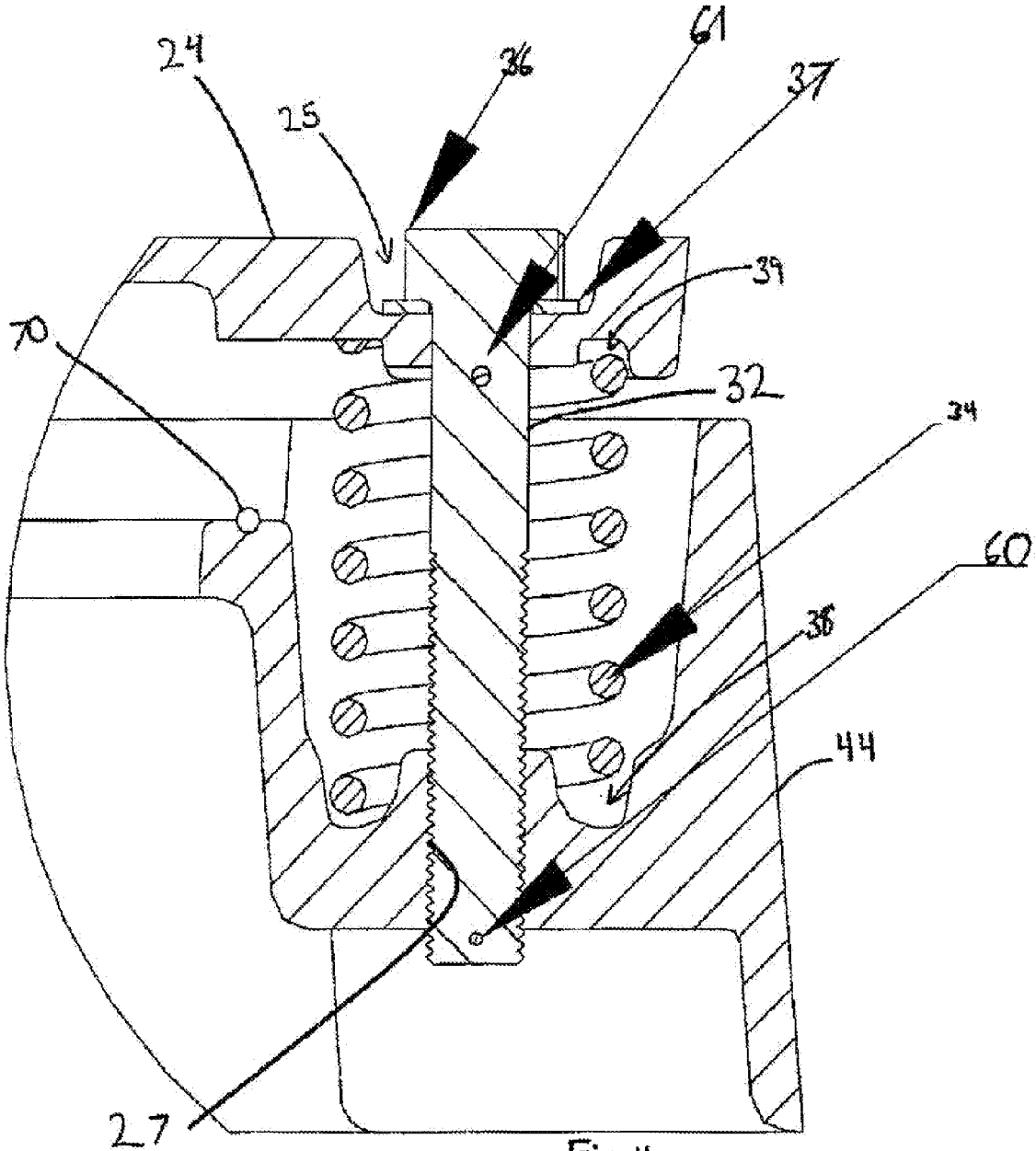
FIG. 4 is a sectional view of the mounting tab and frame supplement of the lift-assisted manhole cover assembly.

The frame 40 may include a frame supplement 44 for supporting the lift-assist mechanisms. In the illustrated embodiment, the frame supplement is a sleeve 44 extending from the outer wall 48 of the frame 40 to define a cavity that houses the lifting elements, such as shaft 32 and spring 34 as shown in FIG. 4. The frame supplement need not be directly attached to the frame 40.

The sleeve 44 is also operatively engaged with the shaft 32. More specifically, the sleeve 44 of the illustrated embodiment defines a threaded hole 27 that threadedly receives the shaft 32. Accordingly, threaded operation of the shaft 32 may be used to selectively control the height of the cover 20. As noted above, in one embodiment, the sleeve 44 is positioned outside of the general periphery of the outer wall 48 of the frame 40, so that the lifting elements do not obstruct access to the frame interior or manhole yet still allows the manhole cover assembly 10 to maintain a flush upper surface.

In the described embodiment, the sleeve 44 defines a bottom channel 38 which helps center the compression spring 34 within the sleeve 44. Further, the bottom channel 38 may provide additional depth to the threaded hole 27, which, among other things, provides a greater engagement between the shaft 32 and the threaded hole 27.

In the described embodiment, an installation flange 46 extends outwardly along the entire periphery of the outer wall 48 at the bottom of the frame 40. Additionally, the frame 40 may include a plurality of support ribs 47 that extend outwardly along the height of the outer wall 48 of the frame 40. A person of ordinary skill in the art would understand how to install a manhole cover assembly 10 using these installation flanges. Accordingly, the various suitable methods of installation are not covered in detail. Generally, one or more layers of asphalt or surfacing materials are poured over the installation flanges 46, 47 and filled up to the surface of a road. In one embodiment, once installed, the road surface (not shown), upper edge of the frame 40, and the closed cover 20 form a substantially flush surface. In alternative constructions, the frame 40 may include additional, fewer, or different installation members.

The cover 20 of this embodiment generally includes a disk 22 and a mounting tab 24. The cover 20 is movably and rotatably mounted to the frame 40. In closed position, shown in FIG. 1, the cover 20 sits within the frame 40 creating a substantially flush surface. In open position, shown in FIG. 3, the cover 20 has been lifted vertically and rotated substantially horizontally to provide access to the manhole through the frame 40.

The disk 22 fits within the frame 40 to removably cover the manhole (not shown). The size of the disk 22 may vary to fit the frame or other various reasons, but typically the disk 22 has a diameter of about 730 millimeters and a thickness of about 25 millimeters. In alternative embodiments, the disk 22 may be replaced with a square, rectangular, or other shaped plate. Although the illustrated disk 22 is made of cast iron, any suitable material may be used.

Although the disk 22 of the described embodiment is generally plain, alternative embodiments may include various enhancements to the disk 22. For example, the disk 22 may include pick holes (not shown) to grip the cover 20 by hand or tool. The surface of the disk 22 may include designs, markings, and/or textures (not shown).

The mounting tab 24 may be integrally formed with or attached to the disk 22 and in this embodiment extends beyond the general periphery of the disk 22. The mounting tab 24 defines a hole 25 for mounting the lifting elements. In other embodiments, the mounting tab 24 is deleted and the hole for mounting the lifting elements is provided in the disk 22. In the illustrated embodiment, the hole 25 is a counter-bored hole, shown in FIG. 5, such that the shaft 32 may be mounted to the mounting tab 24 without extending above the upper surface of the cover 20. Various other types of holes may replace the illustrated hole 25, such as a counter sunk hole.

In the described embodiment, the lower surface of the mounting tab 24 defines an upper channel 38 which helps center the compression spring 34 within the sleeve 44.

A lifting element assists in lifting the cover 20 away from the frame 40. In one embodiment the lifting element is a threaded shaft 32. In another embodiment, the lifting element is a spring 34. The manhole cover assembly may include one or multiple lifting elements. Although the illustrated embodiment includes a spring 34 and a shaft 32, additional, different or fewer lifting or biasing elements may be used.

In threaded shaft embodiments, the shaft 32 extends through or is otherwise operatively mounted to the mounting tab 24 of the cover 20. In the illustrated embodiment, the shaft 32 is a generally conventional bolt. In this embodiment, the head of the shaft 36 and a conventional washer 37 are fitted within the counter-bored hole 25. The bolt may have a conventional head that permit operation of the bolt using conventional tools. Alternatively, the bolt may have a conventional locking head that requires a special tool for operation.

The shaft 32 may also include a pair of cotter pins 60, 61. The lower cotter pin 60 acts as a mechanical stop to prevent the shaft 32 from being completely unscrewed from the frame 40. The position of the lower cotter pin 60 may be selected to adjust the maximum cover 20 height. Although the illustrated embodiment includes a lower cotter pin, the lower pin may alternatively be replaced by other mechanical stops. The upper cotter pin 61 is positioned to help hold the cover 20 level (e.g. perpendicular to the shaft) and to otherwise reduce shaft 32 movement relative to the cover 20. The upper cotter pin 61 of the illustrated embodiment is positioned so that the head 36, washer 37 and cotter pin 61 tightly sandwich the mounting tab 24 to lock it in place. Although the illustrated embodiment includes an upper cotter pin, the upper pin may alternatively be replaced by other various locking structures.

In spring embodiments, the spring 34 is disposed between the cover 20 and the frame 40 or frame supplement 44. The cover 20 is pivotally mounted to the frame 40 or frame supplement 44 using an unthreaded shaft or other suitable mechanism. In the described embodiment, a coil spring 34 is disposed around the threaded shaft 32 within the sleeve 44 of the frame 40, as shown in FIG. 5. Although the illustrated embodiment includes a coil spring 34, other types of springs may be used. For example, the assembly may alternatively include a conical compression spring. The strength of the spring may be selected to balance the weight of the cover 20 so that the cover 20 may be more easily raised and lowered by operation of the shaft 32. In some embodiments, no spring is used at all.

In unthreaded shaft embodiments, the spring may be held compressed with a separate locking mechanism. For example, two additional holes (not shown)—one in the cover 20 and one in the frame 40—may facilitate a bolt to lock the cover 20 and frame 40 in place and maintain tension on the spring 34. In one embodiment, the holes are positioned in a locking tab (not shown) of the cover 20 and a locking flange (not shown) of the frame 40.

III. Use of the Lift-Assisted Manhole Cover Assembly

In use, the lift-assisted manhole cover assembly 10 may be opened by applying an initial force to trigger the lift assist, for example unscrewing the head 36 of the shaft 32. As the head 36 is unscrewed, the spring 34 pushes, directly or indirectly, against the upper channel 39 of the mounting tab 24 to assist in lifting the cover 20. In an alternative embodiment, unscrewing the head 36 of the bolt is sufficient to lift the cover 20 and no additional lifting elements are necessary. The lower cotter pin 60 provides a mechanical stop that engages the sleeve 44 if the shaft 32 is unscrewed to the maximum height of the cover 20. Once the cover 20 has been lifted vertically above the upper edge of the frame 40 the cover 20 may be rotated about the shaft 32. Typically, the cover 20 will be rotated manually.

The lift-assisted manhole cover assembly may be closed by swinging the cover 20 horizontally over the cover receiving flange 42 and screwing the shaft 32 back into the threaded hole 27. In spring embodiments, as the cover 20 is forced down, the spring 34 loads to the appropriate tension until released. In the unthreaded shaft alternative embodiment noted above, the cover 20 is secured in the closed position using the optional separate locking mechanism described above.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A lift-assisted manhole cover assembly comprising:

a manhole frame having a peripheral wall defining an access opening, an upper surface and an integrally formed boss disposed external said peripheral wall defining a threaded opening;

a cover interfitted with said manhole frame to selectively cover said access opening; and threaded shaft mounted to said cover and threadedly mounted to said threaded opening of said integrally formed boss, wherein rotating said threaded shaft axially moves said threaded shaft with respect to said integrally formed boss and in turn moves said cover with respect to said frame, said moved cover is movable along a plane substantially parallel with said upper surface of said manhole frame to provide selective access to said opening.

2. The lift-assisted manhole cover assembly of claim 1 wherein said shaft includes a locking structure for securing said shaft to said cover, whereby said cover is fixed in a substantially perpendicular position to said shaft and linear movement of said shaft is substantially translated into linear movement of said cover.

3. The lift-assisted manhole cover of claim 1 wherein said shaft includes a head and a locking structure sandwiching said cover to secure said shaft to said cover, whereby said cover is held substantially perpendicular to said shaft.

4. The lift-assisted manhole cover of claim 1 wherein said shaft includes a mechanical stop whereby movement of said shaft with respect to said integrally formed boss is limited.

5. The lift-assisted manhole cover of claim 4 wherein position of said mechanical stop may be selected to adjust a maximum cover height.

6. The lift-assisted manhole cover of claim 4 comprising a spring for lifting said cover.

* * * * *